US012163392B2

(12) United States Patent
AlSultan et al.

(10) Patent No.: US 12,163,392 B2
(45) Date of Patent: Dec. 10, 2024

(54) BACK PRESSURE VALVE CAPSULE

(71) Applicant: Saudi Arabian Oil Company, Dhahran (SA)

(72) Inventors: Fuad A. AlSultan, Alahsa (SA); Hemant Kumar Sharma, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/890,964

(22) Filed: Aug. 18, 2022

(65) Prior Publication Data

US 2024/0060376 A1 Feb. 22, 2024

(51) Int. Cl.
*E21B 33/129* (2006.01)
*E21B 23/06* (2006.01)

(52) U.S. Cl.
CPC ..... *E21B 23/06* (2013.01); *E21B 33/1293* (2013.01)

(58) Field of Classification Search
CPC ... E21B 33/1293; E21B 33/1285; E21B 23/06
See application file for complete search history.

(56) References Cited

U.S. PATENT DOCUMENTS 4,949,786 A * 8/1990 Eckert ..... E21B 33/04 166/208
5,509,467 A 4/1996 Gibbs
5,509,476 A 4/1996 Vick, Jr.
2021/0254428 A1* 8/2021 Roessler ..... E21B 23/0413

FOREIGN PATENT DOCUMENTS

AU 2014208221 2/2015
CA 2639869 4/2009

OTHER PUBLICATIONS

SAIP Examination Report in SAIP Appln. No. 123450183, dated Sep. 19, 2024, 11 pages, with English Translation.

* cited by examiner

*Primary Examiner* — Cathleen R Hutchins
*Assistant Examiner* — Ronald R Runyan
(74) *Attorney, Agent, or Firm* — Fish & Richardson P.C.

(57) ABSTRACT

A valve capsule assembly for a well includes a body including a first end, a second end, a cavity, and an exterior surface. The body is sized for positioning inside a bore of a casing. A sealing element is coupled to the exterior surface of the body and is configured for sealing with an interior surface of the casing. A cone is movably disposed in the cavity of the body between the sealing element and the second end of the body. A slip coupled to the exterior surface of the body and is movable between a deactivated configuration and an activated configuration, in which the slip is configured to expand and engage with the interior surface of the casing. When the cone is in a first position, the slip is in the deactivated configuration and when the cone is in a second position, the slip is in the activated configuration.

17 Claims, 3 Drawing Sheets

BACK PRESSURE VALVE CAPSULE

TECHNICAL FIELD

The present disclosure relates to wells.

BACKGROUND

Saltwater disposed (SWD) and power water injector (PWI) wells are completed without tubing. Routine maintenance is conducted by closing the wellhead valves and attending one valve at a time (e.g., the valve is stroked and greased). For defective valves, the wells are secured downhole through one of the two means: either hydraulically by pumping kill fluids or mechanically through installation of monobore (keyless) plugs. Once the well is secured downhole, maintenance for the defective wellhead valve is carried out. Well fluids are prevented from flowing out of the well when performing well maintenance at surface for these types of wells. SWD and PWI wells are also secured while performing other operations, such as, for example, nipple down and up the drilling blowout prevention (BOP) stack, nipple up or down Christmas tree, testing the Christmas tree, and replacing the master valve.

SUMMARY

The present disclosure relates to a capsule assembly installed at a wellhead for wells without tubing, e.g., SWD or PWI wells, to allow installation of a back pressure valve (BPV), a one-way check valve, or a two-way check valve (TWCV) for well securement and to facilitate well maintenance at surface.

In accordance with a first example aspect, a valve capsule assembly for a well may include a capsule body having a first end, a second end opposite the first end, a cavity, and an exterior surface. The capsule body may be sized for positioning inside a bore of a well casing. A sealing element may be coupled to the exterior surface of the capsule body and configured for sealing with an interior surface of the well casing. A capsule cone may be movably disposed in the cavity of the capsule body between the sealing element and the second end of the capsule body. A capsule slip may be coupled to the exterior surface of the capsule body. The capsule slip may be movable between a deactivated configuration and an activated configuration, in which the capsule slip is configured to expand and engage with the interior surface of the well casing. When the capsule cone is in a first position, the capsule slip may be in the deactivated configuration and when the capsule cone is in a second position, the capsule slip may be in the activated configuration.

In accordance with second example aspect, a method of plugging a wellbore may include inserting a capsule assembly into a bore of a casing of a wellbore. The capsule assembly may include a capsule body, a slip coupled to an exterior surface of the capsule body, a capsule cone disposed in a cavity of the capsule body, and a sealing element disposed between the exterior surface of the capsule body and an interior surface of the casing. The capsule body may include a first end and a second end opposite the first end. The method may include coupling the capsule assembly to the casing by activating the slip. Further, the method may include inserting a valve into the cavity of the capsule body at the first end of the capsule body.

In further accordance with any one or more of the foregoing first and second aspects, a valve capsule assembly for a well and/or a method of plugging a wellbore may further include any one or more of the following aspects.

In one example, the capsule cone may be configured for coupling to an installation rod.

In another example, the capsule cone may be threadably coupled to the capsule body.

In some examples, the capsule cone may move in an axial direction when the capsule cone rotates relative to the capsule body.

In other examples, a valve may be coupled to the capsule body between the sealing element and the first end of the capsule body.

In one form, the valve may be a back pressure valve.

In another form, the valve may be a two-way check valve.

In some forms, the capsule body may include an interior surface and a machined profile disposed on the interior surface.

In another form, the machine profile may be proximally located relative to the first end of the capsule body.

In other forms, activating the slip may include3 moving the capsule cone toward the second end of the capsule body to engage the slip with an interior surface of the casing.

In another example, moving the capsule cone may include engaging the capsule cone with a rod and moving the rod and the capsule cone in an axial direction.

In some examples, the method may include disengaging the rod from the capsule cone after activating the slip.

In other examples, inserting the valve may include engaging the rod with the valve.

In one form, the method may include disengaging the rod from the valve.

In another form, inserting the valve may include installing a back pressure valve in the cavity of the capsule body.

In some forms, inserting the valve may include installing a two-way check valve in the cavity of the capsule body.

In other forms, activating the slip may include compressing the slip, wherein the slip is an annular seal.

In some examples, the method may include deactivating the slip by moving the capsule cone toward the second end of the capsule body.

Definitions

As used herein, the terms "top," "bottom," "upper," "lower," "above," and "below" are used to provide a relative relationship between structures. The use of these terms does not indicate or require that a particular structure must be located at a particular location in the apparatus.

Other features and advantages of the present disclosure will be apparent from the following detailed description, the figures, and the claims.

BRIEF DESCRIPTION OF THE DRAWINGS

The following drawings illustrate certain embodiments of the features and advantages of this disclosure. These embodiments are not intended to limit the scope of the appended claims in any manner. Like reference symbols in the drawings indicate like elements.

DETAILED DESCRIPTION

The present disclosure describes an example implementation of a capsule assembly installed at a wellhead for wells without tubing, e.g., SWD or PWI wells, to allow installation of a back pressure valve (BPV), a one-way check valve, or a two-way check valve (TWCV) for well securement and to facilitate well maintenance at surface. By installing a BPV or TWCV in a SWD or PWI well casing, the capsule assembly of the present disclosure may hold subterranean pressure from below the capsule assembly, yet enable fluids to be pumped from above the capsule assembly.

Figure 1:
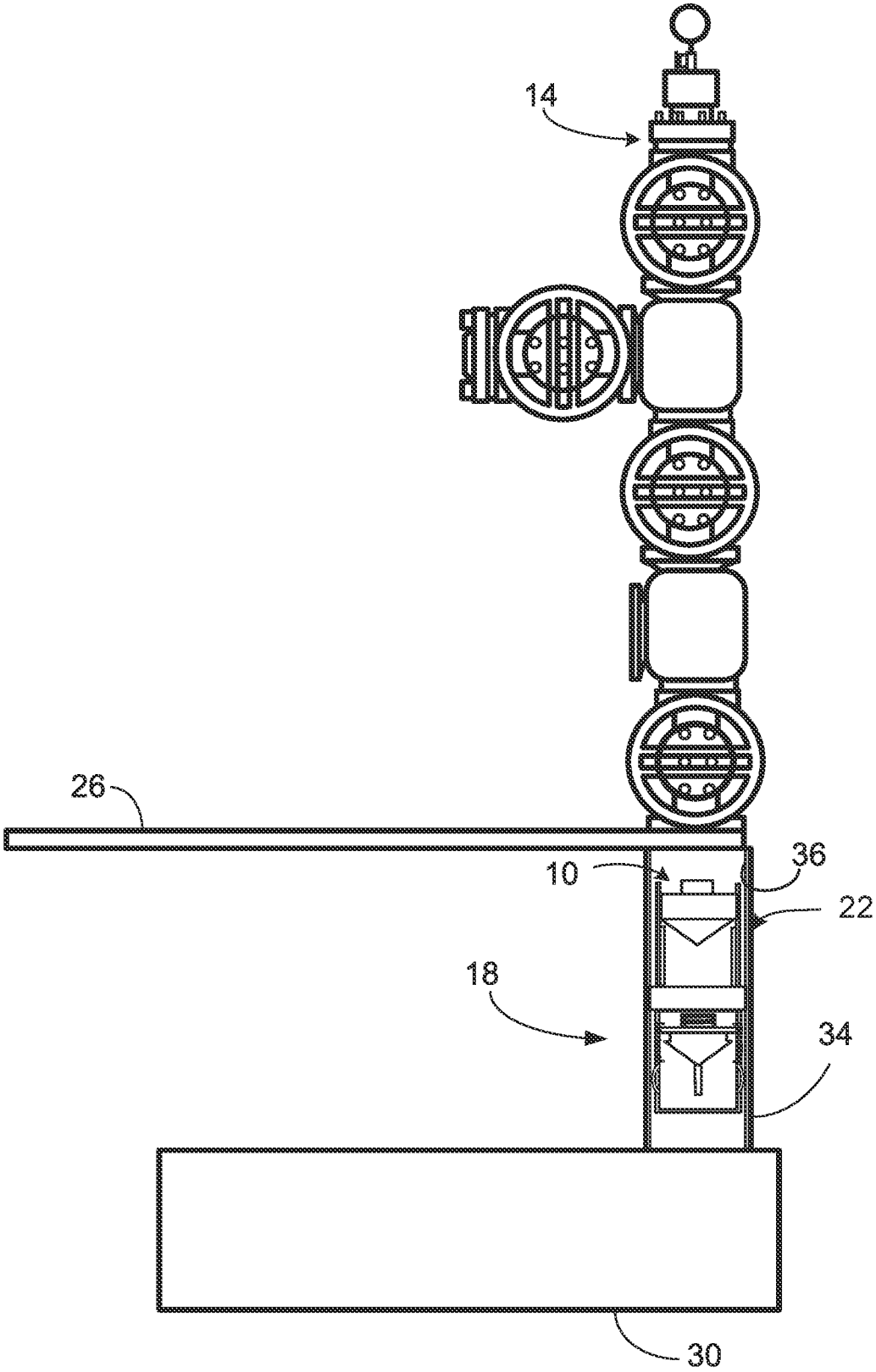
FIG. 1 is a schematic diagram of a capsule assembly installed in a well in accordance with the present disclosure.

FIG. 1 is a schematic diagram of a capsule assembly 10 installed in a wellhead 14 of a salt water disposal (SWD) well 18 in accordance the present disclosure. The well 18 may be part of a water disposal system that may, generally, provide for a complete or total removal of water from a hydrocarbon fluid (for example, oil, gas, or a combination thereof) in order for the removed water to be disposed of in a wellbore fluidly coupled to a subterranean formation. In other examples, the capsule assembly may be installed in other wells without tubing, such as, for example, a PWI well, in a similar manner.

The wellhead 14 is installed on the disposal well 18 and generally, comprises multiple flow control devices, such as valves of various types, sensors, and meters. For example, the wellhead 14 may include a crown valve, a wing valve, a manual master valve, and a surface safety valve. As shown, the well 18, in this example, includes a wellbore 22 formed (for example, drilled or otherwise) from a terranean surface 26 (on land or under a body of water) to a subterranean formation 30. Although the terranean surface 26 is illustrated as a land surface, terranean surface 26 may be a sub-sea or other underwater surface, such as a lake or an ocean floor or other surface under a body of water. Thus, the present disclosure contemplates that the wellbore 22 may be formed under a body of water from a drilling location on or proximate the body of water. The capsule assembly 10 may be useful for a nipple down process, nipple up process, assembling a blowout preventer stack, a nipple up or nipple down process in a Christmas tree operation, testing the Christmas tree, testing the blowout preventer, replacing the master valve, or for wellbore securement to facilitate well maintenance.

In the example of FIG. 1, the illustrated wellbore 22 has a casing 34 positioned and set around the wellbore 22 from the terranean surface 26 into a particular depth in the Earth. For example, the well casing 34 may be a relatively large-diameter tubular member (or string of members) set (for example, cemented) around the wellbore 22 in a shallow formation. As used herein, "tubular" may refer to a member that has a circular cross-section, elliptical cross-section, or other shaped cross-section. The wellbore 22 and associated casing 34 may be formed with various example dimensions and at various example depths (for example, true vertical depth, or TVD). For instance, a conductor casing (not shown) may extend down to about 120 feet TVD, with a diameter of between about 28 in. and 60 in. The surface casing 34 may extend down to about 2500 feet TVD, with a diameter of between about 22 in. and 48 in. The foregoing dimensions are merely provided as examples and other dimensions (for example, diameters, TVDs, lengths) are contemplated by the present disclosure. For example, diameters and TVDs may depend on the particular geological composition of one or more of multiple subterranean formations, particular drilling techniques, or particular secondary operation techniques (for example, perforating, fracturing, acid jobs, fluid injection from other wellbores, and otherwise).

Figure 2:
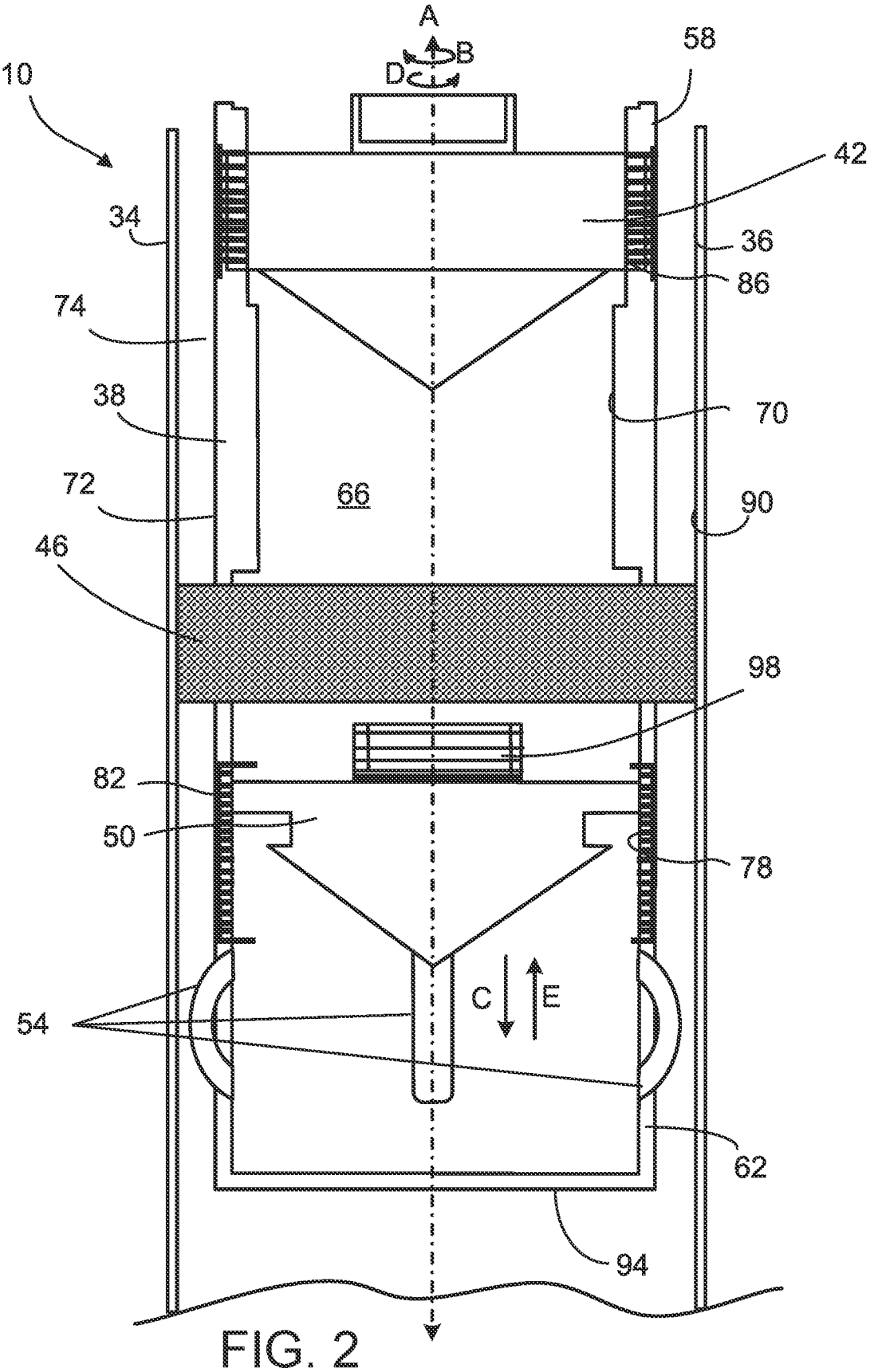
FIG. 2 is a schematic diagram of the capsule assembly of FIG. 1, showing a slip of the capsule assembly in a deactivated configuration in the well casing.

Turning now to FIGS. 1 and 2, the capsule assembly 10 includes a capsule body 38, a valve 42 coupled to the capsule body 38, a sealing element 46 sealing the capsule body 38 to the well casing 34, a capsule cone 50 movable disposed in the capsule body 38, and a capsule slip 54 coupled to the capsule body 38. The capsule assembly 10 is installed through the wellhead 14 of the well 18, permitting the installation of the valve 42 for well securement and to facilitate well maintenance at the surface. The valve 42 is installed after the capsule body 38 is in place in the well casing 34 by inserting the valve 42 through the Christmas tree into a tubing hanger, and inside the well casing 34 at an upper casing spool 36. When the valve 42 of the capsule assembly 10 is installed in the well 18, the capsule assembly 10 may effectively prevent well fluids from flowing out of the well 18. The valve 42 may be a back pressure valve (BPV), a check valve, or a two-way check valve (TWCV). A BPV may be installed to hold pressure from below, yet enable pumping fluids from above, which may be useful for well-control purposes (e.g., uncontrolled flow from the well due to surface leak or faulty valves). BPV can hold pressure from the bottom, which is useful to kill the well in case pressure has developed. In other examples, the valve may be a unidirectional or bi-directional check valve (i.e., TWCV) for well operations such as, for example, testing the Christmas tree. TWCV can hold pressure from two directions, which is useful for pressure testing new valves installed in the Christmas tree.

In FIG. 2, the capsule body 38 includes a first end 58, a second end 62 opposite the first end 58, a cavity 66, an interior surface 70, and an exterior surface 72. The capsule body 38 is sized for positioning inside a bore 74 of the well casing 34, and is sized to receive the valve 42 at the first end 58 and the capsule cone 50 at the second end 62. At the second end 62, the interior surface 70 of the capsule body 38 includes internal threading 78 that is arranged for threadably coupling the capsule body 38 to external threads 82 of the capsule cone 50. Similarly at the first end 58, the interior surface 70 of the capsule body 38 includes a machined profile 86 that facilitates installation of the valve 42 at the first end 58 to plug and secure the well 18. The second end 62 is closed whereas the first end 58 is open to facilitate installing the valve 42 in the capsule body 38, and the capsule assembly 10 in the well casing 34, as will be described below with respect to FIGS. 3-7.

The sealing element 46 is an elastomer sealing element that creates a seal between the exterior surface 72 of the capsule body 38 and an interior surface 90 of the well casing spool 36. The sealing element 46 is disposed on the exterior surface 72 of the capsule body 38 and is axially positioned between the valve 42 and the capsule cone 50. The sealing element 46 seals the bore 74 or annulus between the capsule body 38 and the well casing 34, thereby preventing any fluids from the wellbore to surface through the bore 74 of the well casing 34. In the illustrated example, the capsule assembly 10 includes one sealing element 46. However, in other examples, the capsule assembly 10 may include more than one sealing element at various locations on the exterior surface 72 of the capsule body 38.

The capsule cone 50 is a movably disposed in the cavity 66 at the second end 62 of the capsule body 38 between a first position, as shown in FIG. 2, in which the slip 54 is deactivated, and a second position (FIG. 4), in which the slip 54 is activated. In the second position, the capsule cone 50 is lower (relative to the orientation shown in FIGS. 1-7) in the cavity 66 (i.e., closer to a tip 94 of the second end 62) and engages the slip 54. To move the capsule cone 50, a rod 102 (FIGS. 3-5) removably coupled to a first end 98 of the capsule cone 50 rotates the capsule cone 50 relative to the capsule body 38. In particular, the external threads 82 of the capsule cone 50 are threadably coupled to the internal threads 78 of the capsule body 38, permitting controlled axial movement of the capsule cone 50.

To activate and deactivate the slip 54, an operator may rotate the capsule cone 50 (e.g., via the rod) about a longitudinal axis A to move the capsule cone 50 in the axial direction. For example, when the capsule cone 50 is rotated in a B direction, the capsule cone 50 moves axially toward the second end 62 of the capsule body 38 in a C direction. When the capsule cone 50 is rotated in a D direction opposite the B direction, the capsule cone 50 moves in an E direction opposite the C direction and toward the first end 58. The internal threads 78 of the capsule body 38 may be arranged to limit the axial travel of the capsule cone 50 facilitate covering and uncovering a trigger location of (i.e., location of activating) the slip 54. In the illustrated example, the capsule cone 50 is built into the capsule assembly 10, whereas the valve 42 may be first selected from a plurality of different valves before being installed in the capsule body 38, depending on the application of the well operation. However, in other examples, the capsule cone 50 may also be installed in the capsule body 38 after the capsule body 38 is in place within the well casing 34.

The slip 54 is used to connect the capsule assembly 10 to the well casing 34. The slip 54 is disposed on the exterior surface 72, and at the second end 62, of the capsule body 38. So configured, when the capsule cone 50 reaches the second position within the cavity 66 of the capsule body 38, the slip 54 is activated and radially expands outwardly to engage the interior surface 90 of the well casing spool 36. A portion of the slip 54 is fixed to the capsule body 38 such that when the slip 54 expands to engage with the interior surface 90 of the well casing spool 36, the slip 54 remains fixed to the capsule body 38, thereby anchoring the capsule assembly 10 to the well casing 34. The slip 54 will allow the installation of the capsule assembly 10 inside the casing spool 36 without the need to have any specific profile.

Figures 3, 4, 5, 6, 7:
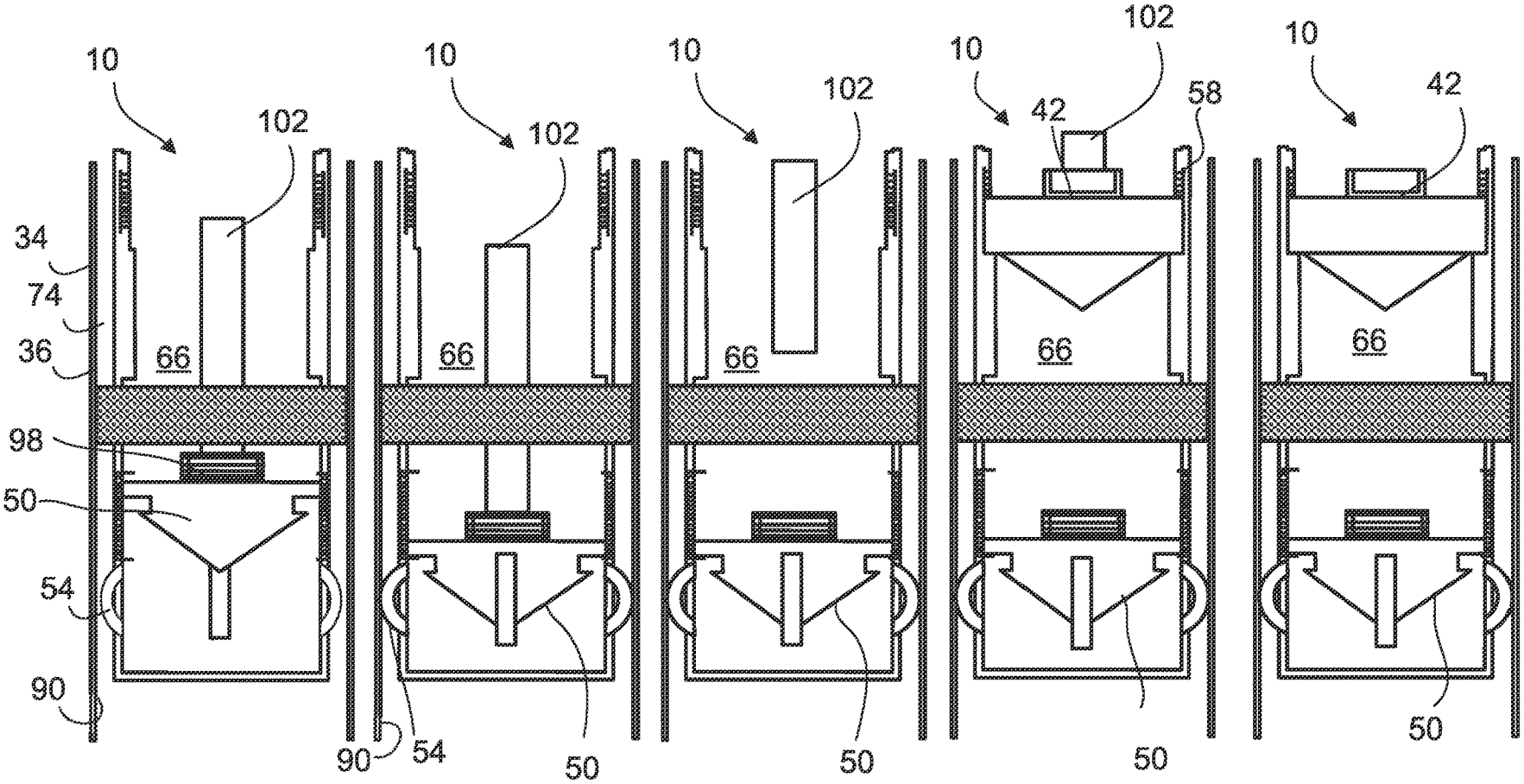
FIG. 3 is a first step of installing the capsule assembly of FIG. 1 in a well casing.
FIG. 4 is a second step of installing the capsule assembly, showing the slip in an activated configuration.
FIG. 5 is a third step of installing the capsule assembly, showing a removal of a rod.
FIG. 6 is a fourth step of installing the capsule assembly, showing inserting a valve with a rod into a capsule body of the capsule assembly.
FIG. 7 is a fifth step of installing the capsule assembly without the rod.

A method of installing the capsule assembly 10 in a well casing 34 includes some example steps that are illustrated in FIGS. 3-7. In FIG. 3, a first step includes installing the capsule assembly 10 in a bore 74 of a well casing 34. An installation rod 102 coupled to the first end 98 of the capsule cone 50 may be used to move the capsule cone 50 from the first position, shown in FIG. 3, to the second position, shown in FIG. 4. In the second position, the capsule cone 50 activates the slip 54, thereby coupling the capsule body 38 of the capsule assembly 10 to the well casing 34. In a subsequent step, the installation rod 102 is decoupled from the first end 98 of the capsule cone 50, leaving the capsule cone 50 in the second position as shown in FIG. 5. The same or different installation rod 102 may be used to install the valve 42 in the cavity 66 at the first end 58 of the capsule body 38, as shown in FIG. 6. Here, the rod 102 couples the valve 42 in place against the interior machined profile 86 of the capsule body 38. Finally, as shown in FIG. 7, the rod 102 is removed from the valve 42 and the capsule assembly 10 is installed in the well casing 34. In this position, the well may be serviced as needed.

A capsule assembly 10 for installing a valve 42 to isolate a well as described in the present disclosure may facilitate performing various well operations for wells without tubing (e.g., PWI and SWD wells). The disclosed capsule assembly 10 is easy to install at the wellhead and may be customized using different types of valves based on the application. Installing and anchoring the capsule assembly 10 to a well casing may further advantageously improve field operation efficiency, minimize health and safety risks, as well as reduce operating expenditure.

Whilst the invention has been disclosed in particular embodiments, it will be understood by those skilled in the art that certain substitutions, alterations and/or omissions may be made to the embodiments without departing from the spirit of the invention. Accordingly, the foregoing description is meant to be exemplary only, and should not limit the scope of the invention. All references (including those listed above), scientific articles, patent publications, and any other documents cited herein are hereby incorporated by reference for the substance of their disclosure.

The invention claimed is:

1. A valve capsule assembly for a well, the assembly comprising:

a capsule body comprising a first end, a second end opposite the first end, a cavity, and an exterior surface, the capsule body sized for positioning inside a bore of a well casing;

a sealing element coupled to the exterior surface of the capsule body and configured for sealing with an interior surface of the well casing;

a capsule cone movably disposed in the cavity of the capsule body between the sealing element and the second end of the capsule body; and a capsule slip coupled to the exterior surface at an outer diameter the capsule body, the capsule slip movable between a deactivated configuration and an activated configuration, in which the capsule slip is configured to expand and engage with the interior surface of the well casing; and a two-way check valve coupled to the capsule body between the sealing element and the first end of the capsule body;

wherein when the capsule cone is in a first position, the capsule slip is in the deactivated configuration and when the capsule cone is in a second position, the capsule slip is in the activated configuration.

2. The assembly of claim 1, wherein the capsule cone is configured for coupling to an installation rod.

3. The assembly of claim 1, wherein the capsule cone is threadably coupled to the capsule body.

4. The assembly of claim 3, wherein the capsule cone moves in an axial direction when the capsule cone rotates relative to the capsule body.

5. The assembly of claim 1, wherein the two-way check valve is a back pressure valve.

6. The assembly of claim 1, wherein the capsule body comprises an interior surface and a machined profile disposed on the interior surface, the machine profile being proximally located relative to the first end of the capsule body.

7. The assembly of claim 1, wherein the capsule body is sized to receive the capsule cone at the second end of the capsule body.

8. A method of plugging a wellbore, the method comprising:

inserting a capsule assembly into a bore of a casing of a wellbore, the capsule assembly comprising a capsule body, a slip coupled to an exterior surface of the capsule body, a capsule cone disposed in a cavity of the capsule body, and a sealing element disposed between the exterior surface of the capsule body and an interior surface of the casing, wherein the capsule body comprises a first end and a second end opposite the first end;

coupling the capsule assembly to the casing by activating the slip;

inserting a valve into the cavity of the capsule body at the first end of the capsule body; and deactivating the slip by moving the capsule cone toward the second end of the capsule body.

9. The method of claim 8, wherein activating the slip comprises moving the capsule cone toward the second end of the capsule body to engage the slip with an interior surface of the casing.

10. The method of claim 9, wherein moving the capsule cone comprises engaging the capsule cone with a rod and moving the rod and the capsule cone in an axial direction.

11. The method of claim 10, comprising disengaging the rod from the capsule cone after activating the slip.

12. The method of claim 10, wherein inserting the valve comprises engaging the rod with the valve.

13. The method of claim 12, comprising disengaging the rod from the valve.

14. The method of claim 8, wherein inserting the valve comprises installing a back pressure valve in the cavity of the capsule body.

15. The method of claim 8, wherein inserting the valve comprises installing a two-way check valve in the cavity of the capsule body.

16. The method of claim 8, wherein activating the slip comprises compressing the slip, wherein the slip is an annular seal.

17. A valve capsule assembly for a well, the assembly comprising:

a capsule body comprising a first end, a second end opposite the first end, a cavity, and an exterior surface, the capsule body sized for positioning inside a bore of a well casing;

a sealing element coupled to the exterior surface of the capsule body and configured for sealing with an interior surface of the well casing;

a capsule cone movably disposed in the cavity of the capsule body between the sealing element and the second end of the capsule body; and a capsule slip coupled to the exterior surface of the capsule body, the capsule slip movable between a deactivated configuration and an activated configuration, in which the capsule slip is configured to expand and engage with the interior surface of the well casing;

wherein when the capsule cone is in a first position, the capsule slip is in the deactivated configuration and when the capsule cone is in a second position, the capsule slip is in the activated configuration;

wherein the capsule cone is threadably coupled to the capsule body; and wherein the capsule cone moves in an axial direction when the capsule cone rotates relative to the capsule body.

* * * * *